US008965256B2

(12) United States Patent
Kawanami et al.

(10) Patent No.: US 8,965,256 B2
(45) Date of Patent: Feb. 24, 2015

(54) IMAGE FORMING APPARATUS

(71) Applicant: Canon Kabushiki Kaisha, Tokyo (JP)

(72) Inventors: Takeo Kawanami, Yokohama (JP); Masahiro Suzuki, Numazu (JP); Masaru Shimura, Yokohama (JP); Shinji Katagiri, Yokohama (JP); Tatsuya Kinukawa, Kawasaki (JP); Shigeru Hoashi, Numazu (JP); Akinori Takayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 13/688,480

(22) Filed: Nov. 29, 2012

(65) Prior Publication Data

US 2013/0164049 A1 Jun. 27, 2013

(30) Foreign Application Priority Data

Nov. 30, 2011 (JP) ..... 2011-262593

(51) Int. Cl.
*G03G 15/01* (2006.01)
*G03G 15/16* (2006.01)

(52) U.S. Cl.
CPC ..... *G03G 15/16* (2013.01); *G03G 15/1615* (2013.01)
USPC ..... 399/302; 399/308

(58) Field of Classification Search
USPC ..... 399/302, 308
See application file for complete search history.

(56) References Cited

U.S. PATENT DOCUMENTS

| | | | |
|---|---|---|---|
| 4,470,682 | A | 9/1984 | Suzuki et al. |
| 5,915,145 | A | 6/1999 | Shimura et al. |
| 6,052,549 | A | 4/2000 | Shimura et al. |
| 6,173,135 | B1 | 1/2001 | Yuminamochi et al. |
| 6,266,495 | B1 | 7/2001 | Yuminamochi et al. |
| 6,282,384 | B1 | 8/2001 | Saito et al. |
| 6,560,426 | B2 | 5/2003 | Sakaizawa et al. |
| 6,603,935 | B2 | 8/2003 | Tsuruya et al. |
| 6,611,669 | B2 | 8/2003 | Suzuki et al. |
| 6,711,367 | B2 | 3/2004 | Saito et al. |
| 6,859,631 | B2 | 2/2005 | Suzumi et al. |
| 6,963,716 | B2 | 11/2005 | Kobayashi et al. |
| 7,366,445 | B2 | 4/2008 | Hoashi et al. |
| 7,620,354 | B2 | 11/2009 | Shimura et al. |
| 7,835,678 | B2 | 11/2010 | Yasumaru et al. |
| 7,978,998 | B2 | 7/2011 | Nakagawa et al. |
| 8,068,775 | B2 | 11/2011 | Inaba et al. |

(Continued)

FOREIGN PATENT DOCUMENTS

| | | | |
|---|---|---|---|
| JP | 2005-195724 | A | 7/2005 |
| JP | 2005-321556 | A | 11/2005 |
| JP | 2007-183651 | A | 7/2007 |

*Primary Examiner* — David Gray
*Assistant Examiner* — Michael Harrison
(74) *Attorney, Agent, or Firm* — Fitzpatrick, Cella, Harper & Scinto

(57) ABSTRACT

An image forming apparatus includes an image bearing member unit including a toner image carrying member, a transfer unit including a movable endless belt for transferring the toner image from the carrying member onto a transfer material, a plurality of stretching members for stretching the endless belt, and a supporting portion, provided at an end portion with respect to a widthwise direction, for supporting the stretching members. In addition, a main assembly frame is provided at a position opposing the supporting portion and includes a positioning portion for determining positions of the plurality of stretching members, wherein the supporting portion is movable relative to the main assembly frame.

10 Claims, 8 Drawing Sheets

(56) References Cited

U.S. PATENT DOCUMENTS

| | | | | |
|---|---|---|---|---|
| 8,103,189 | B2 * | 1/2012 | Maeda | 399/121 |
| 8,112,014 | B2 | 2/2012 | Kawanami | |
| 8,116,668 | B2 | 2/2012 | Koyanagi et al. | |
| 8,165,512 | B2 | 4/2012 | Doda et al. | |
| 8,175,474 | B2 | 5/2012 | Kinukawa et al. | |
| 8,180,247 | B2 | 5/2012 | Nakagawa et al. | |
| 8,185,003 | B2 | 5/2012 | Hirai et al. | |
| 8,229,305 | B2 | 7/2012 | Kinukawa et al. | |
| 8,238,807 | B2 | 8/2012 | Doda et al. | |
| 8,280,285 | B2 | 10/2012 | Inaba et al. | |
| 8,290,385 | B2 | 10/2012 | Nakagawa et al. | |
| 8,320,805 | B2 | 11/2012 | Yasumaru et al. | |
| 8,355,650 | B2 | 1/2013 | Kawanami | |
| 8,369,726 | B2 | 2/2013 | Kinukawa et al. | |
| 2009/0232530 | A1 | 9/2009 | Saito et al. | |
| 2009/0296147 | A1 | 12/2009 | Kinukawa et al. | |
| 2011/0188902 | A1 | 8/2011 | Katagiri et al. | |
| 2011/0293324 | A1 | 12/2011 | Hoashi | |
| 2012/0195605 | A1 | 8/2012 | Hirai et al. | |
| 2012/0230741 | A1 | 9/2012 | Yasumaru et al. | |
| 2012/0269557 | A1 | 10/2012 | Doda et al. | |
| 2012/0300009 | A1 | 11/2012 | Toyoizumi et al. | |

* cited by examiner

IMAGE FORMING APPARATUS

FIELD OF THE INVENTION AND RELATED ART

The present invention relates to an image forming apparatus such as a copying machine, a printer, etc., which has an endless belt. More specifically, it relates to an electrophotographic or electrostatic image forming apparatus which directly transfers toner image(s) formed on its image bearing member(s) onto a sheet of recording medium electrostatically adhered to its recording medium conveying electrostatic endless belt. It also relates to an electrophotographic or electrostatic image forming apparatus which transfers toner image(s) formed on its image bearing member(s) onto its endless intermediary transfer belt, and then, transfers the toner image(s) from the intermediary transfer belt onto a sheet of recording medium being conveyed by a recording medium conveying means.

It has been known that some color image forming apparatuses, such as a color copying machine, a color laser printer, or the like, have an intermediary transferring member. A color image forming apparatus having an intermediary transferring member forms a color image through a primary transfer process in which toner image(s) formed on a photosensitive drum, as an image bearing member, are sequentially layered on its intermediary transferring member, and a secondary transfer process in which the layered toner images on the intermediary transferring member are transferred together onto a sheet of recording medium.

The majority of the intermediary transferring members are in the form of an endless belt. Therefore, in order to form a high quality image, it is necessary to highly precisely position endless belt suspending multiple rollers, relative to the main assembly of an image forming apparatus. This is true in the case of an image forming apparatus which uses an electrostatic endless belt for conveying a sheet of recording medium. It is also true in the case of an image forming apparatus structured so that its endless belt and belt supporting multiple rollers are integrated in the form of a transfer unit, which is removably installable in the main assembly of the image forming apparatus.

In the case of an image forming apparatus disclosed in Japanese Laid-open Patent Application 2005-195724, the frame of the transfer unit for the image forming apparatus is made up of three sections, and the intermediary frame is given a certain amount of flexibility to enable the transfer unit to adapt to the frame of the main assembly of the image forming apparatus.

The structural arrangement of the image forming apparatus disclosed in Japanese Laid-open Patent Application 2005-195724, however, was intended to precisely position the top portion of the endless belt, in terms of the loop which the belt forms, relative to the frame of the main assembly of the image forming apparatus, in terms of the moving direction of the top portion of the endless belt. Therefore, it cannot ensure that each of the belt suspending rollers is precisely positioned (aligned) in terms of the moving direction of the top portion of the endless belt, in terms of the belt loop. Further, the belt frame is made up of three sections, allowing thereby the left and right sections of the belt frame to become misaligned, which in turn makes it possible for the transfer unit to be attached to the frame of the main assembly of the image forming apparatus at an unintended angle.

SUMMARY OF THE INVENTION

Thus, the primary object of the present invention is to provide an image forming apparatus which is simple in structure and inexpensive, and yet, can highly precisely position its endless belt relative to the frame of its image assembly.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

First, referring to FIGS. 1-5, the image forming apparatus in the first embodiment of the present invention is described about its general structure.

General Structure of Image Forming Apparatus

Figure 1:
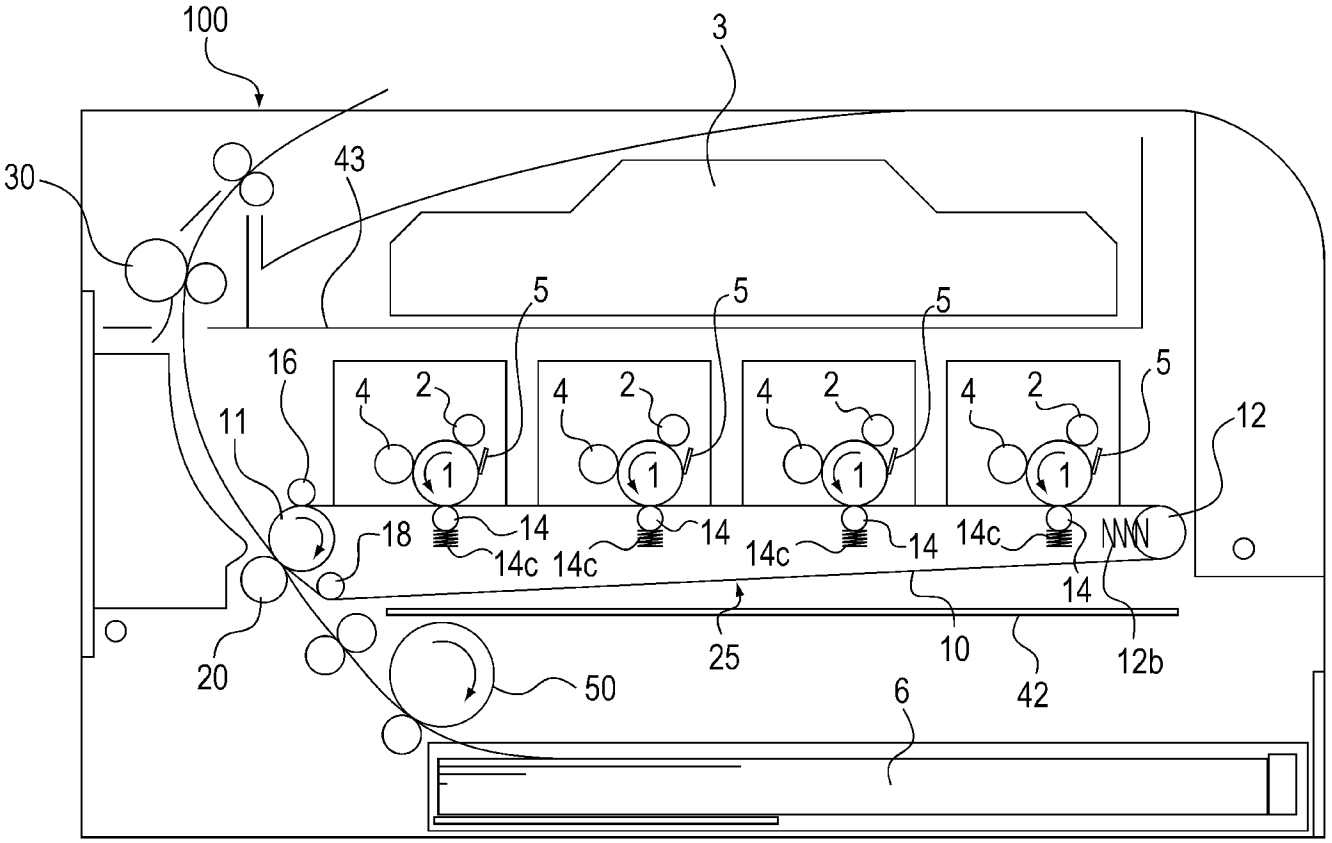
FIG. 1 is a schematic sectional view of the image forming apparatus in the first embodiment of the present invention, and shows the general structure of the apparatus.

Referring to FIG. 1, the image forming apparatus 100 in this embodiment is a color image forming apparatus of the so-called intermediary transfer belt type, which forms a toner image (or toner images) on one or more of its photosensitive drums 1 (as image bearing members), transfers the toner image(s) onto its intermediary transfer belt 10 (endless belt) from the photosensitive drum(s), and then, transfers the toner image(s) onto a sheet of recording medium from the intermediary transfer belt 10.

Referring to FIG. 1, the image forming apparatus 100 has four image formation stations a, b, c, and d. The four image formation stations are the same in structure, although they are different in the color of the toner they use as developer. Thus, they are going to be described together, with reference to the image formation station a.

The image formation station a has a photosensitive drum 1*a* as an image bearing member, which is rotated in the direction indicated by an arrow mark in FIG. 1, at a preset peripheral velocity (process speed). Hereafter, the image formation station is referred to as a drum unit, that is, an image bearing member unit having an image bearing member.

While the photosensitive drum 1*a* is rotated as described above, its peripheral surface is uniformly charged to a preset polarity and a preset potential level by a charge roller 2*a* as a charging means. Then, the charged portion of the peripheral surface of the photosensitive drum 1*a* is exposed by an exposure unit 3*a* as an exposing means. Consequently, an electrostatic latent image, which corresponds to yellow component to which a multicolor image to be formed was separated, is formed on the peripheral surface of the photosensitive drum 1*a*. Then, the electrostatic latent image is developed by a developing device 4*a* into a visible image, that is, an image formed of toner, in the development station a.

The intermediary transfer belt 10 is suspended and kept tensioned by three belt suspending members, more specifically, a belt driving roller 11 (which hereafter will be referred simply as driving roller 11), a tension tensioning roller 12 (which hereafter will be referred to simply as tension roller), and an auxiliary roller 18. It is circularly moved at roughly the same velocity as the peripheral velocity of the photosensitive drum 1*a*, in such a direction that in the area of contact between itself and the peripheral surface of the photosensitive drum 1*a*, it moves in the same direction as the peripheral surface of the photosensitive drum 1*a*.

After the formation of a toner image on the peripheral surface of the photosensitive drum 1*a*, the toner image is moved through the area of contact (which hereafter may be referred to as "primary transfer nip") between the peripheral surface of the photosensitive drum 1*a* and intermediary transfer belt 10. While the toner image is moved through the primary transfer nip, it is transferred (primary transfer) onto the intermediary transfer belt 10 by the primary transfer voltage applied to a primary transfer roller 14 as a transferring means. The primary transfer residual toner, which is the toner remaining on the peripheral surface of the photosensitive drum 1 after the primary transfer, is removed by a cleaning device 5.

Similarly, a toner image of the second color, a toner image of the third color, and a toner image of the fourth color are sequentially formed by the image formation stations b, c, and d, respectively, and are sequentially transferred in layers onto the yellow toner image on the intermediary transfer belt 10, synthetically effecting a full-color toner image which reflects the original image.

The four toner images, different in color, on the intermediary transfer belt 10 (endless belt) are conveyed through the secondary transfer nip, which is the area of contact between the intermediary transfer belt 10, and a secondary transfer roller 20 (as transferring means) kept pressed against the belt driving roller 11 with the presence of the intermediary transfer belt 10 between itself and driving roller 11. While the four toner images are conveyed through the secondary transfer nip, they are transferred together (secondary transfer) by the secondary transfer voltage applied to the secondary transfer roller 20 by a secondary transfer voltage power source, onto the surface of a sheet 6 of recording medium conveyed to secondary transfer nip, that is, the area of contact between the intermediary transfer belt 10 and the peripheral surface of the secondary transfer roller 20, by a sheet feeding/conveying apparatus 50.

Thereafter, the sheet 6 of recording medium, on the surface of which the four toner images, different in color, are present, is introduced into a fixing device 30, and is conveyed through the fixing device 30. While the sheet 6 is conveyed through the fixing device 30, the sheet 6 and the toner images thereon are subjected to heat and pressure by the fixing device 30. Consequently, the four toner images, different in color, melt, mix, and become fixed to the sheet 6. That is, a full-color print is made through the above described operation.

As for the secondary transfer residual toner, that is, the toner remaining on the surface of the intermediary transfer belt 10 after the secondary transfer, it is removed by a transfer belt cleaning device 16.

Structure of Transfer Unit

Next, the transfer unit 25 of the image forming apparatus in this embodiment is described about its structure. The transfer unit 25 is provided with the endless intermediary transfer belt 10, and three belt suspending members, more specifically, the driving roller 11, tension roller 12, and auxiliary roller 18, by which the intermediary transfer belt 10 is kept suspended and tensioned. Further, the transfer unit 25 has multiple (four in this embodiment) transfer members 14, as the primary transferring members, which oppose the photosensitive drums 1 with the presence of the intermediary transfer belt 10 between themselves and photosensitive drums 1, one for one. The transfer unit 25 has also a supporting frame for supporting the belt suspending members, by their lengthwise ends, in terms of the direction perpendicular to the moving direction of the intermediary transfer belt 10.

Structure of Apparatus Main Frame and Structure of Belt Suspending Member Supporting Portion Next, the main frame of the image forming apparatus (which hereafter may be referred to as "apparatus main assembly frame") in this embodiment is described about its structure.

Figure 3:
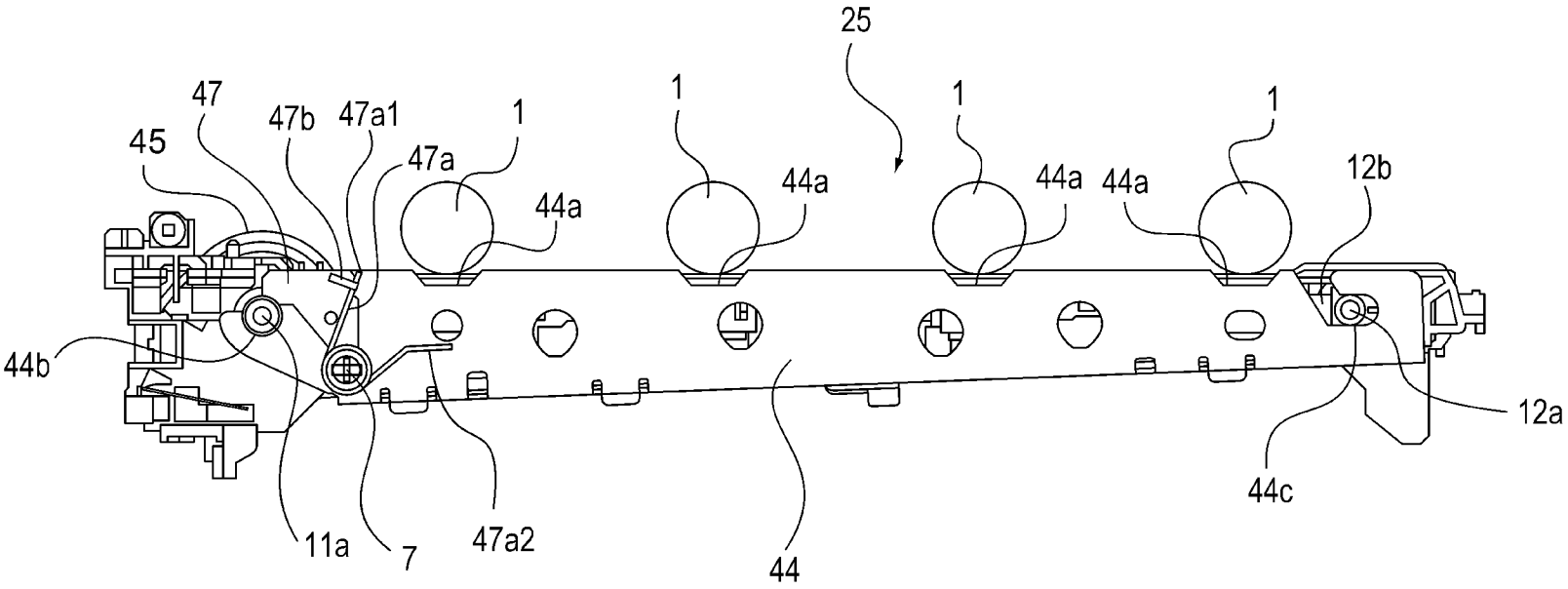
FIG. 3 is a side view of the belt unit and a part of the main frame of the image forming apparatus, in the first embodiment. It shows the structural arrangement for attaching the belt unit to the main frame of the image forming apparatus.

The apparatus main assembly frame supports the main assembly of the image forming apparatus 100, and also, precisely positions various units (drum unit, transfer unit, etc.) of the apparatus relative to the apparatus main assembly. The apparatus main assembly frame is made up of a bottom plate 42, a top plate 43, and a pair of unshown side plates with which the bottom and top plates 42 and 43 are connected to each other. Referring to FIG. 3, the apparatus main assembly frame is also provided with a pair of drum supporting frames 44, which are above the bottom plate 42, and which will be on the outward side of the transfer unit 25 (as belt unit) after the installation of the transfer unit 25 into the apparatus main assembly frame.

Each of the drum supporting frames 44 is provided with a slot (recess, groove) 44*b*, which is semicircular in contour, and an elongated slot 44*c*. The semicircular slot 44*b* and elongated slot 44*c* are portions for precisely positioning the driving roller 11 and tension roller 12, which are two of the belt suspending members. They open upward. The semicircular slot 44*b* and elongated slot 44*c* are where one of the bearings 11*a* which support the lengthwise end portion of the axle of the driving roller 11, and corresponding bearing 12*a* of the tension roller 12, are fitted to precisely position the driving roller 11 and tension roller 12 relative to the drum supporting frames 44 as parts of the apparatus main assembly frame.

Figure 2:
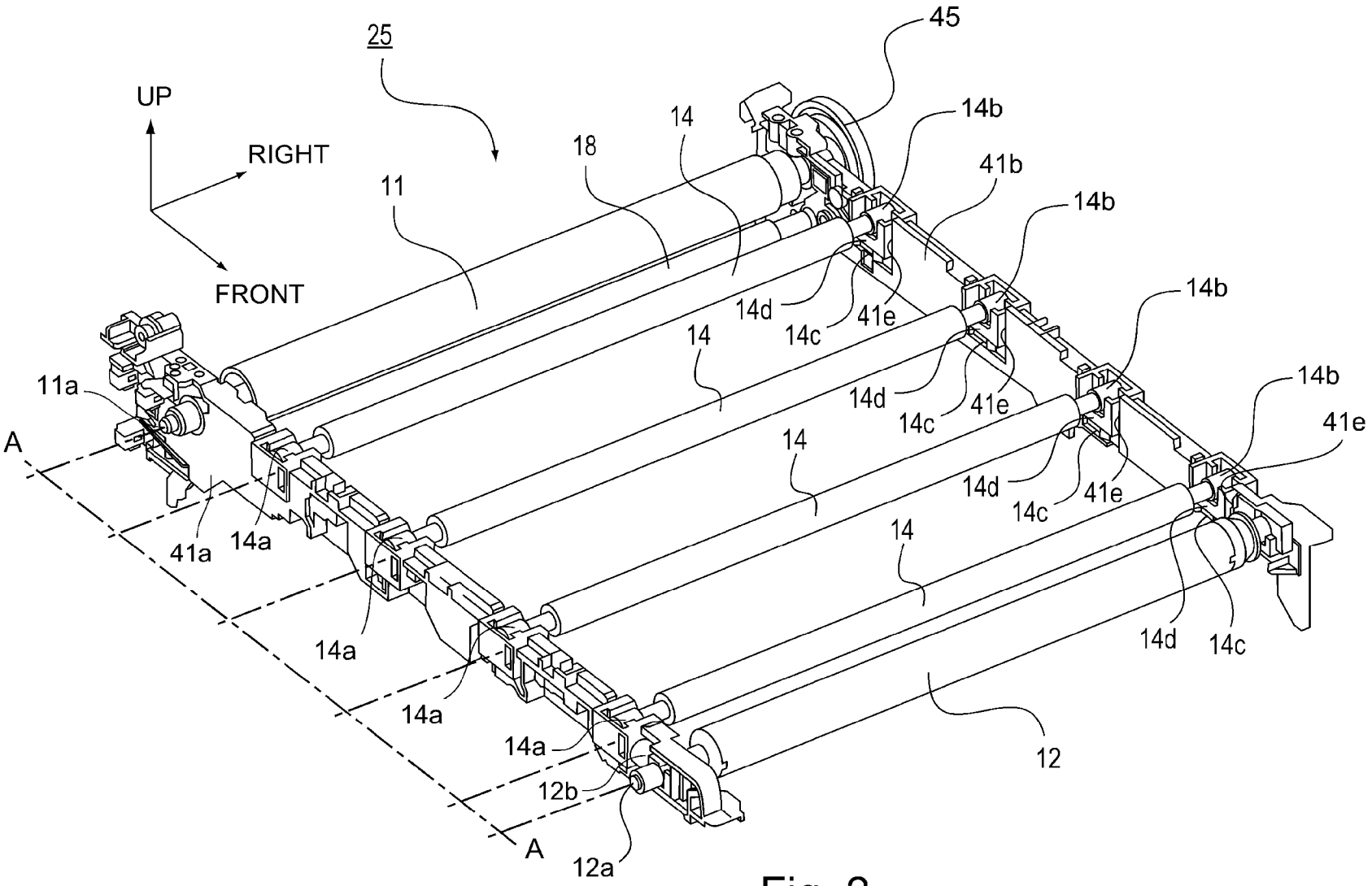
FIG. 2 is a perspective view of the belt unit in the first embodiment made up of an endless belt, belt suspending members, and belt suspending member supporting members. It shows the general structure of the belt unit.

Referring to FIG. 2, in terms of the widthwise direction of the intermediary transfer belt 10, the transfer unit 25 is provided with a pair of side plates 41*a* and 41*b* which support the driving roller 11 and tension roller 12 (which are two of belt suspending members). The image forming apparatus 100 is structured so that the side plates 41*a* and 41*b* are allowed to move relative to the drum supporting frame 44 (which is part of apparatus main assembly frame).

The exposure unit 3 is precisely positioned relative to the apparatus main assembly frame by being attached to the top plate 43.

The drum supporting frame 44 shown in FIG. 3 is one of the pair of drum supporting frames 44 with which the apparatus main assembly frame is provided. The two drum supporting frames 44 are the same in shape and structure, being therefore the same in the shape and structure of the mold therefor. In other words, the two drum supporting frames 44 (left and right frames 44) can be made with the use of the same mold. Using the same mold to make the left and right frames 44 can minimize the difference in size and structure between the two frames 44. The photosensitive drum unit to which the photosensitive drums 1 belong is precisely positioned relative to each of the drum supporting frames 44 by the drum supporting portions 44*a* of the drum supporting frame 44.

Each of the drum supporting frames 44 is provided with a semicircular slot (recess, groove) 44*b*, as the driving roller positioning portion, into which the bearing 11*a* for supporting the axle of the driving roller 11 (one of belt suspending members) is fitted. It is also provided with an elongated slot 44*c*, as the tension roller positioning portion, into which the bearing 12*a* for supporting the axle of the tension roller 12 (one of belt suspending members) is fitted. It is by these slots 44*b* and 44*c*, as the positioning portions, that the transfer unit 25 is precisely positioned relative to the apparatus main assembly.

Because the photosensitive drum unit, transfer unit 25, and drum supporting frame 44 are structured as described above, the drum unit and transfer unit 25 can be highly precisely positioned relative to each other by a single component, that is, the drum supporting frame 44.

Structure of Transfer Unit

Next, referring to FIG. 2, the transfer unit 25 in this embodiment is described about its structure. The intermediary transfer belt 10 is suspended and kept tensioned by the driving roller 11 (which drives intermediary transfer belt 10), tension roller 12, and auxiliary roller 18 (which is positioned next to secondary transfer nip). The tension roller 12 is made by the resiliency of a pair of tension springs 12*b*, to keep the intermediary transfer belt 10 tensioned. The axle of each of the belt suspending members is rotatably supported by the side plates 41*a* and 41*b* of a belt suspending member supporting frame, with the placement of a pair of bearings between the lengthwise ends of the axle of each of the rollers 11 and 12, and plates 41*a* and 41*b*, one for one, as shown in FIG. 1.

Figure 4:
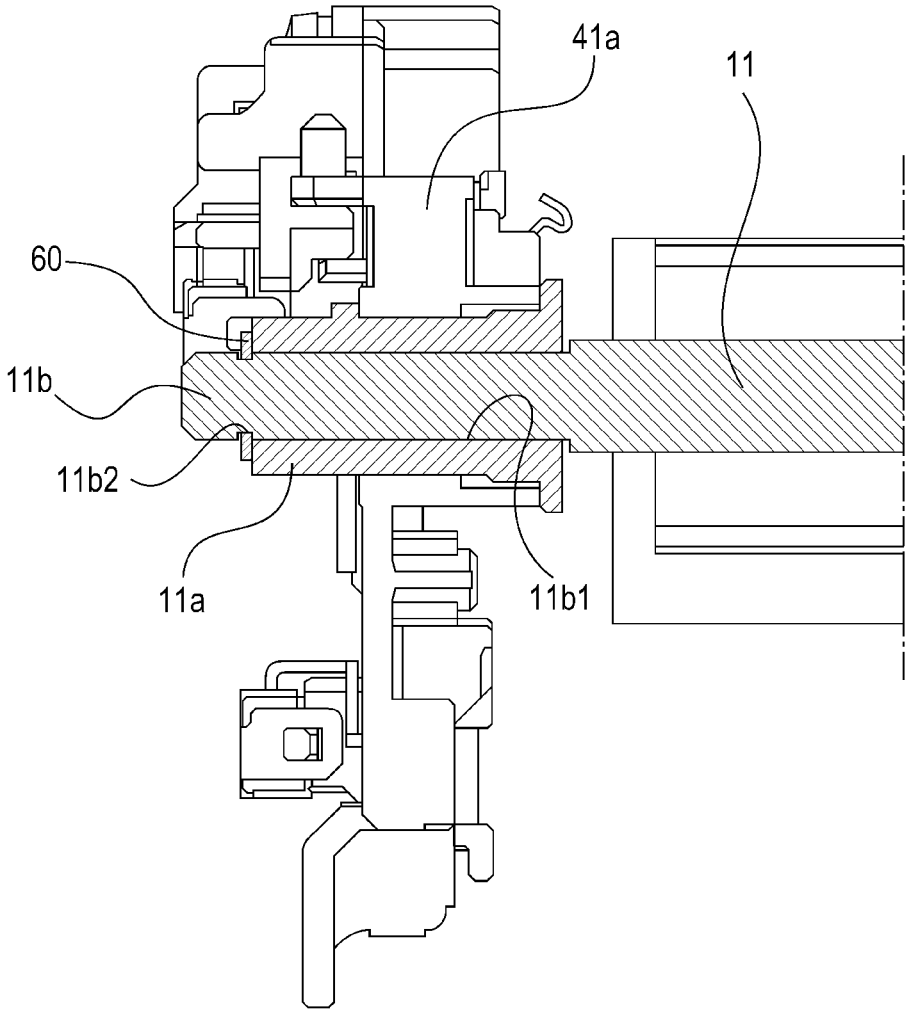
FIG. 4 is a schematic sectional view of one of the pair of bearings for the belt driving roller (which is one of belt suspending members), and its adjacent components. It shows the structure of the bearing and adjacent components.

Next, referring to FIGS. 2 and 4, the driving roller 11 is provided with a gear 45, which is fixed to one of the lengthwise ends of the axle 11*b* of the driving roller 11. Further, the gear 45 is in mesh with an unshown driving gear, with which the apparatus main assembly is provided. Thus, as rotational force is transmitted from the apparatus main assembly to the driving roller 11, the intermediary transfer belt 10 is circularly moved. FIG. 4 is a sectional view of one of the lengthwise end portions of the driving roller 11 and side plate 41*a* (which supports driving roller 11).

Referring to FIG. 4, the driving roller 11 is attached to the side plate 41*a*. More specifically, a bearing 11*a* for rotatably supporting the driving roller 11 by the lengthwise end portion 11*b* of the driving roller 11 is snap-fitted in a hole with which the side plate 41*a* is provided, and the lengthwise end portion 11*b* is borne by the bearing 11*a*. The lengthwise end portion 11*b*1 is smaller in diameter than the main portion of the axle of the driving roller 11, and is provided with a groove 11*b*2, into which a retainer ring 60 is fitted to prevent the driving roller 11 from disengaging from the bearing 11*a* (side plate 41*a*). The structural arrangement for attaching the other lengthwise end portion of the driving roller 11 to the side plate 41*b*, that is, the opposite side plate to the side plate 41*a*, is similar to the above described structural arrangement for attaching the lengthwise end portion 11*b* to the side plate 41*a*.

Because the driving roller 11 is attached to the left and right side plates 41*a* and 41*b* as described above, it is ensured that a preset distance can be maintained between the two side plates 41*a* and 41*b* (which support driving roller 11). The transfer unit 25 is structured so that the side plates 41*a* and 41*b* can be pivotally moved about the axle 11*b* of the driving roller 11, and also, so that the two side plates 41*a* and 41*b* are allowed to move relative to the apparatus main assembly frame, within a range of the play afforded between the axle 11*b* of the driving roller 11, and the side plates 41*a* and 41*b*, in both the direction parallel to a top portion of the intermediary transfer belt 10, in terms of the loop which the belt 10 forms, and the direction perpendicular to the top portion of the intermediary transfer belt 10 in terms of the loop which the belt 10 forms; the two side plates 41*a* and 41*b* are afforded some latitude in terms of their movement relative to the apparatus main assembly frame in terms of horizontal and vertical direction.

It is desired that the transfer unit 25 is structured so that the left and right side plates 41*a* and 41*b* are allowed to move horizontally (forward or backward in terms of top portion of belt) and vertically relative to the apparatus main assembly frame, within a range of 0.1 mm-1.0 mm. Structuring the transfer unit 25 as described above allows the transfer unit 25 to be flexible.

It is also desired that the side plates 41*a* and 41*b* are molded of a highly rigid substance such as poly-carbonate. The transfer unit 25 may be provided with an additional member (members), besides the driving roller 11, for keeping the left and right side plate 41*a* and 41*b* connected. In a case where an additional member (members) is provided, it is desired that the additional member connects the left and right side plates 41*a* and 41*b* in such a manner that two side plates 41*a* and 41*b* are allowed to move relative to each other.

Figure 5:
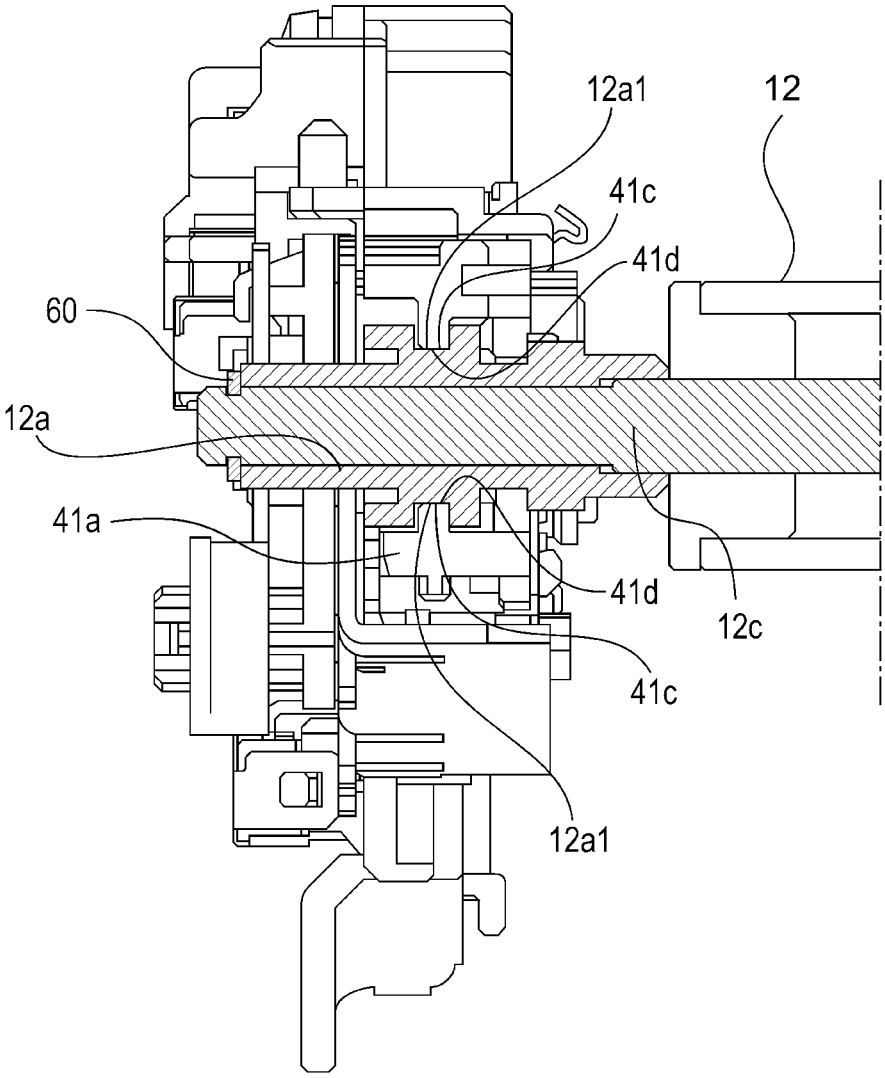
FIG. 5 is a schematic sectional view of one of a pair of bearings for the tension roller (which also is one of belt suspending members), and its adjacent components. It shows the structure of the bearing and adjacent components.

Next, referring to FIG. 5, the tension roller 12 also is supported by the side plates 41*a* and 41*b*. More specifically, each of the side plates 41*a* and 41*b* is provided with an elongated slot 41*c*. The bearing 12*a* which rotatably supports one of the lengthwise ends of the rotational axle 12*c* of the tension roller 12 is fitted in the elongated slot 41*c*, being therefore allowed to move within the slot. Thus, the tension roller 12 is supported by the left and right side plates 41*a* and 41*b* in such a manner that it is allowed to move in the direction parallel to the moving direction of the top portion of the intermediary transfer belt 10 in terms of the loop which the intermediary transfer belt 10 forms.

Referring also to FIG. 5, a protruding portion 41*d* of the side plate 41*a*, which provides the elongated slot 41*c* with the top edge, fits in the recess 12*a*1 with which the peripheral surface of the bearing 12*a* for the tension roller 12 is provided. Thus, the bearing 12*a* for the tension roller 12 is allowed to slide along the edge of the elongated slot 41*c*; the tension roller 12 is allowed to move following the edge (contour) of the elongated slot 41*c*. Further, the transfer unit 25 is provided with a pair of compression springs 12*b*, which keep the tension roller 12 pressured in such a direction that the intermediary transfer belt 10 is provided with a preset amount of tension.

Referring back to FIG. 2, each of the primary transfer rollers 14 is supported by the side plates 41*a* and 41*b*, with the placement of the bearings 14*a* and 14*b* between the lengthwise end portions of the roller 14 and the bearings 14*a* and 14*b*, one for one. The peripheral surface of each of the bearings 14*a* and 14*b* is provided with a protrusion 14*d*, which is fitted in a groove 41*e* with which the corresponding side plate 41*a* (or 41*b*) is provided. Thus, the primary transfer roller 14 is allowed to vertically (FIG. 2) slide along the groove 41*e*. In terms of the direction parallel to the widthwise direction of the intermediary transfer belt 10, however, the primary transfer roller 14 is not allowed to move relative to the side plates 41*a* and 41*b*.

Next, referring to FIGS. 1 and 2, the transfer unit 25 is provided with a pair of primary transfer springs 14*c*, which are under the bearings 14*a* and 14*b*, one for one, for the primary transfer roller 14. Thus, the primary transfer roller 14 is kept pressed against the photosensitive drum 1, with the presence of the intermediary transfer belt 10 between itself and the peripheral surface of the photosensitive drum 1, by the pressure generated by the primary transfer springs 14*c*.

The primary transfer spring 14*c* is positioned so that its axial line coincides with the straight line (line A-A in FIG. 2) between the axial line of the bearing 11*a* which is between the driving roller 11 and side plates 41*a* or 41*b*, and the axial line of the bearing 12*a* which is between the tension roller 12 and side plates 41*a* or 41*b*. In other words, the transfer unit 25 is structured so that the side plates 41*a* and 41*b* are not subjected to torsional moment, while the transfer unit 25 is allowed to be flexible.

Structural Arrangement for Attaching Transfer Unit to Apparatus Main Assembly Frame The transfer unit 25 and image forming apparatus 100 are structured so that the former is removably installable in the main assembly of the latter.

Referring to FIGS. 2 and 4, the driving roller 11 is one of the rollers for suspending the intermediary transfer belt 10 of the transfer unit 25, and its lengthwise end portions are fitted with the pair of bearings 11*a* and 11*b*, one for one, which are put through the side plates 41*a* and 41*b*, and project outward of the side plates 41*a* and 41*b*, respectively. Next, referring to FIG. 3, the transfer unit 25 is precisely positioned relative to the drum supporting frame 44 by the bearings 11*a* and 11*b* for the driving roller 11; the portion of the bearing 11*a* (11*b*) is fitted in the semicircular slot (recess) 44*b*, which opens upward and functions as the driving roller positioning portion of the drum supporting frame 44.

A driving roller pressing member 47, shown in FIG. 3, presses on the peripheral surface of the bearing 11*a* for the driving roller 11, keeping thereby the bearing 11*a* in the slot (groove) 44*b*, that is, the driving roller positioning portion of the drum supporting frame 44. The driving roller pressing member 47 (which hereafter will be referred to simply as pressing member 47) is under the pressure generated by a torsional coil spring 47*a*.

The pressing member 47 is fitted around a boss 7, being enabled to pivot about the boss 7. One end 47*a*1 of the torsional coil spring 47*a* fitted around the boss 7 is rested on (attached to) a catch 47*b* with which the pressing member 47 is provided. The other end 47*a*2 of the torsional coil spring 47*a* is rested on (attached to) an unshown catch with which the drum supporting frame 44 is provided.

Next, referring to FIG. 3, the bearing 12*a* by which the axle of the tension roller 12 is borne is fitted in the elongated slot 44*c* with which the drum supporting frame 44 is provided. The elongated slot 44*c* is roughly U-shaped in contour, and opens upward. Thus, the bearing 12*a* is allowed to move along the edge of the elongated slot 44*c*. Therefore, the tension roller 12 is allowed to horizontally slide along the edge of the elongated slot 44*c*, that is, in the lengthwise direction of each of the drum supporting frames 44.

The transfer unit 25 is structured to be flexible, and the left and right side plates 41*a* and 41*b* are precisely positioned relative to the drum supporting frame 44 by the bearings 11*a* and 11*b* for the driving roller 11, and the bearing 12*a* and 12*b* for the tension roller 12. Therefore, the transfer unit 25 is highly precisely positioned relative to the main assembly of the image forming apparatus 100.

As described above, the transfer unit 25 is structured to be flexible, and the bearings 11*a* and 11*b* for the driving roller 11 and the bearings 12*a* and 12*b* for the tension roller 12 are positioned relative to the drum supporting frame 44 by being fitted in the circular slot 44*b* and elongated slot 44*c*, respectively, which function as the driving roller positioning portion and tension roller positioning portion of the drum supporting frame 44. In other words, the transfer unit 25 and main frame of the image forming apparatus 100 in this embodiment are simple in structure, being therefore inexpensive, and yet, the former is highly precisely positioned relative to the latter.

Also because the transfer unit 25 and apparatus main assembly are structured as described above, the intermediary transfer belt 10 is stable in performance in terms of recording medium conveyance; it does not suffer from the problem that it deviates in position in its widthwise direction and/or rides onto the side plate. Further, it is ensured that the primary transfer rollers 14 remain precisely positioned relative to the photosensitive drums 1, one for one. Therefore, it does not occur that the image forming apparatus 100 outputs images suffering from such defects that are attributable to scattered toner, color deviation, and/or the like.

Embodiment 2

Figure 6:
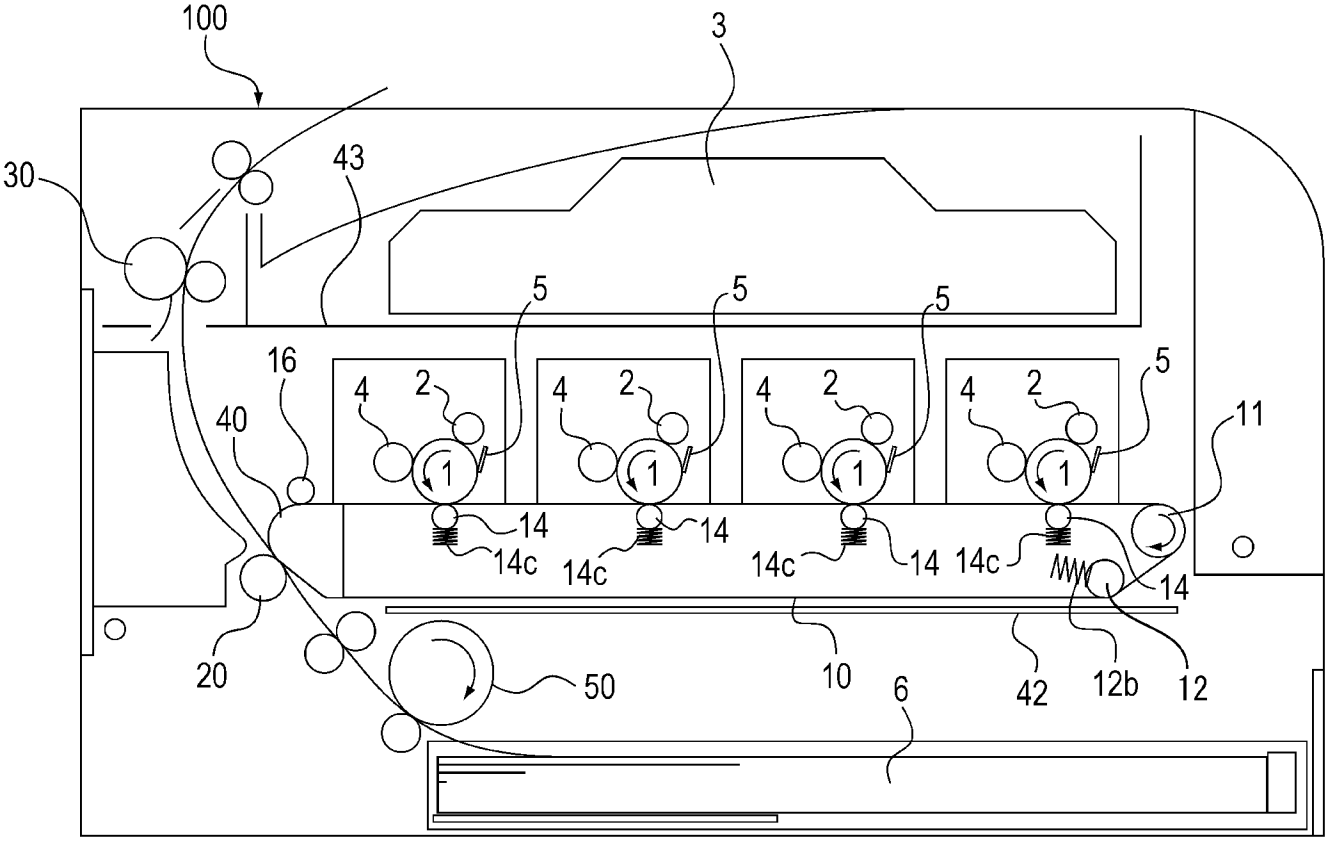
FIG. 6 is a schematic sectional view of the image forming apparatus in the second embodiment of the present invention, and shows the general structure of the apparatus.
Figure 7:
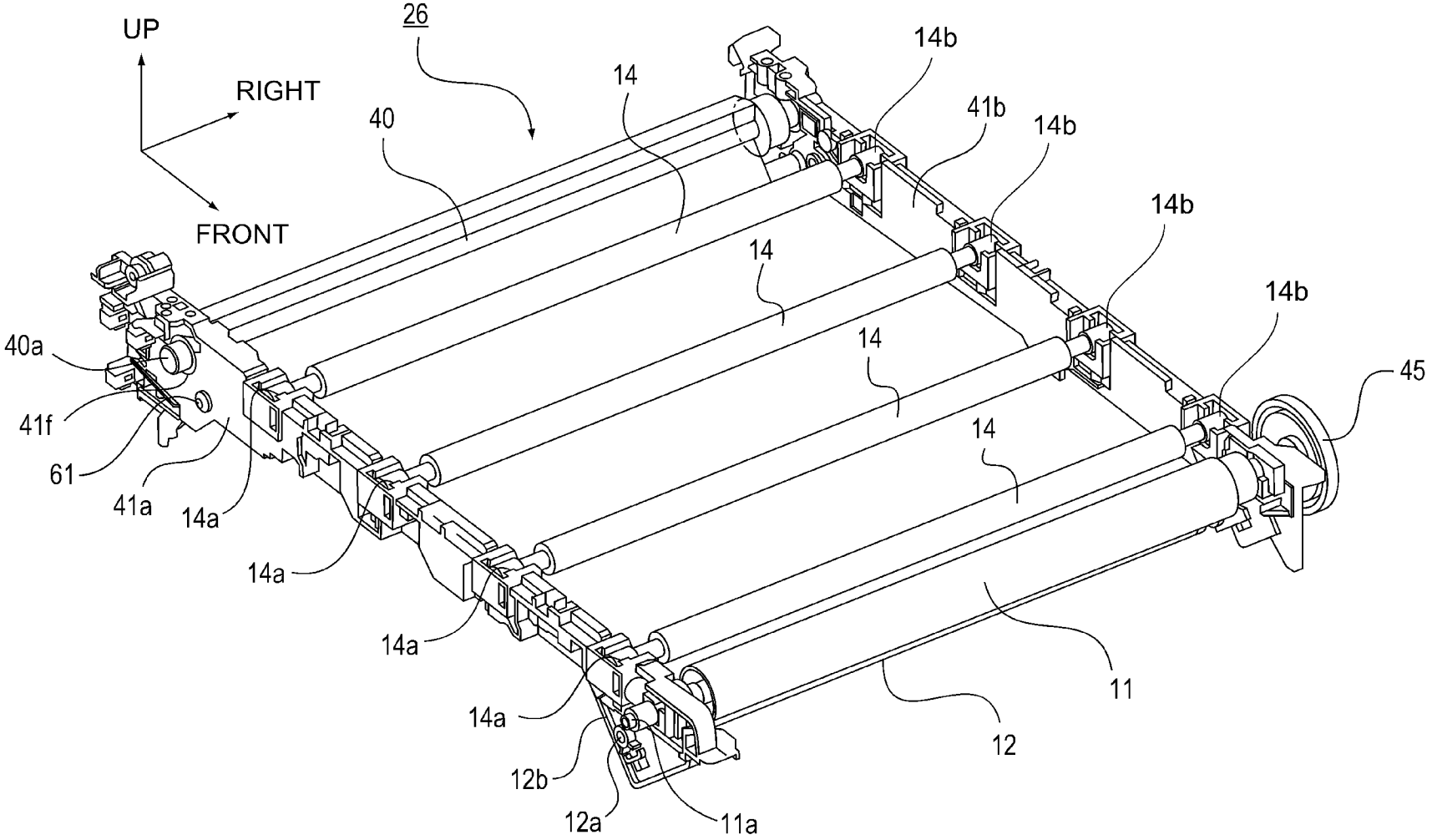
FIG. 7 is a perspective view of the belt unit in the second embodiment, which is made up of an endless belt, belt suspending members, and belt suspending member supporting members. It shows the general structure of the belt unit.
Figure 8:
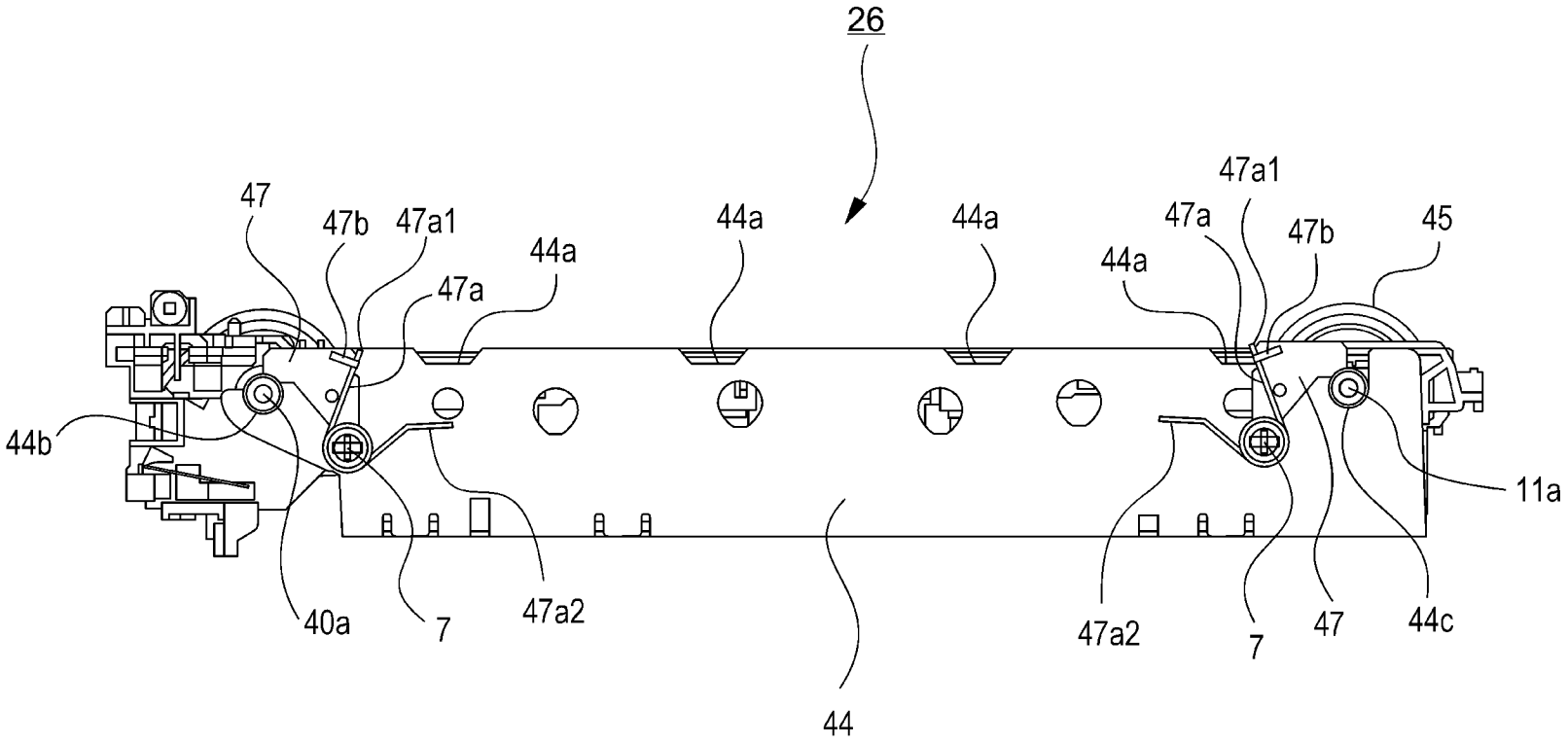
FIG. 8 is a side view of the belt unit and a part of the main frame of the image forming apparatus, in the second embodiment. It shows the structural arrangement for attaching the belt unit to the main frame of the image forming apparatus.

Next, referring to FIGS. 6-8, the image forming apparatus in the second embodiment of the present invention is described about its structure. The components of the apparatus in this embodiment, which are the same in structure as the counterparts in the first embodiment are given the same referential codes as those given to the counterparts in the first embodiment, and are not going to be described here.

In the above-described first embodiment, it was the driving roller 11 (one of belt suspending members) that was positioned opposite to the secondary transfer roller 20 with reference to the intermediary transfer belt 10. In this embodiment, the transfer unit 25 is provided with a belt suspending/backing member 40, which is positioned on the inward side of the intermediary transfer belt 10, in terms of the loop which the belt 10 forms, and against which the secondary transfer roller 20 is pressed with the presence of the intermediary transfer belt 10 between itself and belt suspending/backing member 40. That is, the intermediary transfer belt 10 in this embodiment is suspended and kept tensioned by the belt suspending/backing member 40, driving roller 11, and tension roller 12. Thus, as the intermediary transfer belt 10 is circularly moved, its inward surface slides on the belt suspending/backing member 40. Unlike the driving roller 11 and tension roller (which is rotated by movement of belt 10), the belt suspending/backing member 40 does not move with the intermediary transfer belt 10. That is, it is the same portion of the surface of the belt suspending/backing member 40 that remains in contact with the inward surface of the intermediary transfer belt 10.

In this embodiment, it is by the belt suspending/backing member 40, driving roller 11, and tension roller 12 that the intermediary transfer belt 10, which is an endless belt, is suspended and kept tensioned.

The surface layer of the belt suspending/backing member 40 is formed of polyethylene, which is low in friction and electrically conductive. The secondary transfer roller 20 is kept pressed against the belt suspending/backing member 40 with the presence of the intermediary transfer belt 10 between itself and belt suspending/backing member 40. Thus, as a sheet 6 of recording medium is conveyed, it is pinched between the secondary transfer roller 20 and intermediary transfer belt 10 backed up by the belt suspending/backing member 40.

As the sheet 6 of recording medium is conveyed by the sheet feeding/conveying device 50 through the secondary transfer nip, which is between the intermediary transfer belt 10 and secondary transfer roller 20, the toner images on the intermediary transfer belt 10 are transferred together onto the sheet 6 by the secondary transfer voltage applied to the secondary transfer roller 20 by a secondary transfer voltage power source.

Each of the primary transfer nips, which is the area of contact between the photosensitive drum 1 and primary transfer roller 14, is on the downstream side of the belt suspending/backing member 40 in terms of the moving direction of the intermediary transfer belt 10. Further, the driving roller 11 is on the downstream side of the belt suspending/backing member 40. Therefore, it does not occur that the intermediary transfer belt 10 slackens in the secondary transfer nip and primary transfer nip. In other words, it is ensured that the intermediary transfer belt 10 is circularly moved while remaining properly tensioned. Further, the tension roller 12 is on the downstream side of the driving roller 11 in terms of the moving direction of the intermediary transfer belt 10, and is kept pressed diagonally rightward and downward direction in FIG. 6 by the force generated by the tension springs 12*b*.

Structure of Transfer Unit

Next, referring to FIG. 7, the transfer unit 26 in this embodiment is described. Each of the lengthwise ends of the belt suspending/backing member 40 is provided with a positioning boss 40*a*, which functions also as the portion by which the belt suspending/backing member 40 is supported. The belt suspending/backing member 40 is precisely positioned by being supported by the belt backing member supporting portion of the apparatus main assembly frame. More specifically, each of the side plates 41*a* and 41*b* of the apparatus main assembly frame, which support the belt suspending/backing member 40, is provided with a belt suspending/backing member positioning hole 41*f* (which hereafter will be referred to simply as positioning hole 41*f*). The positioning bosses 40*a* of the belt suspending/backing member 40 are put through the positioning hole 41*f* of the side plate 41*a* and the positioning hole 41*f* of the side frame 41*b*.

The belt suspending/backing member 40 is attached to the side plates 41*a* and 41*b* with the use of a pair of shouldered small screws 62, one for one. As the belt suspending/backing member 40 is attached to the side plates 41*a* and 41*b*, the three components form a U-shaped frame.

The belt suspending/backing member 40 may be connected to the side plates 41*a* and 41*b* with the use of a pair of the small shouldered screws. However, it is desired that they are not extremely rigidly connected.

The belt suspending/backing member 40 serves three roles, that is, the role of keeping the intermediary transfer belt 10 suspended while providing the intermediary transfer belt 10 with a preset amount of tension, the role of keeping the sheet 6 of recording medium pinched between the intermediary transfer belt 10 and secondary transfer roller 20 by backing the intermediary transfer belt 10 to transfer the toner images on the intermediary transfer belt 10 onto the sheet 6, and the role of making up a part of the frame of the transfer unit 26.

The driving roller 11 is supported by the side plates 41*a* and 41*b*; the bearings 11*a* (and 11*b*) for the driving roller 11 are inserted in the unshown elongated slots with which the side plates 41*a* and 41*b* are provided one for one. The transfer unit 26 is structured so that the driving roller 11 is not allowed to shift in the direction perpendicular to the top portion of the intermediary transfer belt 10, in terms of the loop which the intermediary transfer belt 10 forms, and also, in the direction (left and right directions in FIG. 7) parallel to the widthwise direction of the intermediary transfer belt 10, but is allowed to shift (slide) in the direction parallel to the moving direction of the top portion of the intermediary transfer belt 10, in terms of the belt loop. In this embodiment, the driving roller 11 is not specifically controlled in position in terms of the direction parallel to the top portion of the intermediary transfer belt 10 in terms of the belt loop.

In terms of the structural arrangement for supporting the primary transfer rollers 14 and tension roller 12, the embodiment is the same as the first embodiment.

As described above, the transfer unit 26 also is structured to be flexible.

Structural Arrangement for Attaching Transfer Unit to Apparatus Main Assembly Frame Next, referring to FIG. 8, shown is the structural arrangement for attaching the transfer unit 26 to the drum supporting frame 44, which is a part of the frame of the main assembly of the image forming apparatus.

The drum supporting frame 44 is provided with a recess (groove) 44*b*, in which the belt backing member supporting member positioning boss 40*a*, which functions also as the belt backing member supporting portion, is fitted. The recess 44*b* opens upward, and is semicircular in contour. Further, the drum supporting frame 44 is provided with an elongated slot 44*c*, in which the bearing 11*a* for the driving roller 11, by which the driving roller 11 is supported, is fitted. The elongated slot 44*c* is open upward, and is roughly U-shaped in contour. The positioning boss 40*a* of the belt suspending/backing member 40 is inserted into the slot 44*b* of the drum supporting frame 44, and is kept pressed by the pressing member 47 in the same manner as the bearing 11*a* for the driving roller 11 was in the first embodiment.

The pressing member 47 shown in FIG. 8 is kept pressed upon the top portion of the peripheral surface of the positioning boss 40*a* of the belt suspending/backing member 40, by the force generated by the torsional coil spring 47*a*, so that the positioning boss 40*a* is kept pressed in the slot 44*b* of the drum supporting frame 44, which functions as the belt suspending/backing member positioning portion.

The transfer unit 26 is structured so that the pressing member 47 is pivotally movable about a boss 7. One end 47*a*1 of the torsional coil spring 47 fitted around the boss 7 is rested on (attached to) a catch 47*b* with which the pressing member 47 is provided. The other end 47*a*2 of the torsional coil spring 47*a* is rested on (attached to) an unshown catch with which the drum supporting frame 44 is provided.

The driving roller 11 is supported by the side plates 41*a* and 41*b*; the bearings 11*a* and 11*b* for the driving roller 11 are fitted in the unshown elongated slots of the side plates 41*a* and

41*b*, respectively. Therefore, the driving roller 11 is allowed to slide in the direction parallel to the top portion of the intermediary transfer belt 10, in terms of the belt loop. Thus, the bearings 11*a* and 11*b* can be fitted into the elongated slots 44*c* by sliding the driving roller 11 to the top opening of the elongated slots 44*c* which function as the portions for positioning the driving roller 11 relative to the drum supporting frame 44. The bearings 11*a* and 11*b* for the driving roller 11 are kept pressed by the pressing members 47 in the same manner as the above described positioning boss 40*a* of the bearing 11*a*.

The side plates 41*a* and 41*b*, which function as the transfer unit supporting portions, support the belt suspending/backing member 40, driving roller 11, and tension roller 12, which function as the belt suspending members, at their lengthwise ends, in terms of the widthwise direction of the intermediary transfer belt 10, which is an endless belt. Further, the side plates 41*a* and 41*b* are attached to the drum supporting frame 44, which is a part of the frame of the apparatus main assembly, in such a manner that the former is movable relative to the latter. Thus, the transfer unit 26 is properly positioned relative to the main assembly of the image forming apparatus 100.

The left and right drum supporting frames 44 are the same in structural component, and therefore, are minimum in difference. Thus, precisely positioning the belt suspending/backing member 40 and driving roller 11 relative to the left and right drum supporting frames 40 ensures that they are highly precisely aligned.

The force for driving (rotating) the driving roller 11 is transmitted to the driving roller 11 by meshing the gear 45 attached to the driving roller 11, with the gear with which the apparatus main frame is provided. Thus, it is ensured by precisely positioning the driving roller 11 relative to the main assembly of the image forming apparatus 100 that the two gears remain precisely engaged for the driving roller rotating force to be highly precisely transmitted to the driving roller 11.

As described above, the belt suspending/backing member 40 which opposes the secondary transfer roller 20 is used as the component for positioning the transfer unit 26, and also, is given the role of being a part of the frame of the transfer unit 26. Thus, the transfer unit 26 is simpler in structure and lower in cost than the transfer unit 25 in the first embodiment.

Further, the belt suspending/backing member 40 and driving roller 11 are kept highly precisely positioned in terms of both the direction parallel to the top portion of the intermediary transfer belt 10 in terms of the belt loop, and the direction perpendicular to the top portion of the intermediary transfer belt 10 in terms of the belt loop. More specifically, they are kept highly precisely positioned by placing the positioning boss 40*a* of the belt suspending/backing member 40, and the bearing 11*a* for the driving roller 11, in the circular slot 44*b* and elongated slot 44*c*, respectively, of the drum supporting frame 44, which function as the belt backing member positioning portion and driving roller positioning portion, respectively. Therefore, it is ensured that the intermediary transfer belt 10 is reliably moved.

Incidentally, in each of the preceding two embodiments of the present invention, the present invention was applied to the image forming apparatus 100 of the intermediary transfer type, which employs an intermediary transfer belt. That is, in the case of the preceding embodiments, the toner images formed on the photosensitive drums 1, which are image bearing members, were transferred onto the intermediary transfer belt 10, and then, are transferred onto the sheet 6 of recording medium from the intermediary transfer belt 10. However, the present invention is also applicable to an image forming apparatus which employs an endless electrostatic belt for conveying a sheet of recording medium, that is, an image forming apparatus which directly transfers the toner images formed on the photosensitive drums 1, which are image bearing members, onto the sheet of recording medium being conveyed by the electrostatic endless belt while remaining electrostatically adhered to the belt.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 262593/2011 filed Nov. 30, 2011, which is hereby incorporated by reference.

What is claimed is:

1. An image forming apparatus comprising:

a plurality of image bearing member units provided with image bearing members for carrying toner images, respectively;

a transfer unit including a movable endless belt for transferring the toner image from said respective image bearing members onto a transfer material, a plurality of stretching members for stretching said endless belt, and a first frame portion supporting said stretching members;

a second frame portion provided at a position opposing said first frame portion and including first positioning portions for determining positions of the plurality of stretching members and second positioning portions for determining positions of said image bearing member units, respectively, wherein said first frame portion is movable relative to said second frame portion in a state that said stretching members are positioned by said first positioning portions.

2. An image forming apparatus according to claim 1, wherein said first frame portion includes two side frames provided at opposite end portions of said belt with respect to a widthwise direction perpendicular to a movement direction of said belt.

3. An image forming apparatus according to claim 1, wherein one of said stretching members is a driving roller having a shaft for moving said endless belt, a bearing portion supporting said shaft is provided in said first frame portion.

4. An image forming apparatus according to claim 3, wherein said first frame portion includes two side frames, an interval between which is maintained by said driving roller.

5. An image forming apparatus according to claim 3, wherein said first frame portion includes two side frames, which are rotatable about a rotational axis of said driving roller.

6. An image forming apparatus according to claim 5, wherein said two side frames are movable relative to said main assembly frame within a range of a gap between said bearing portion and said driving roller in said bearing portion, and the gap in the widthwise direction is maintained by said driving roller.

7. An image forming apparatus according to claim 3, wherein a bearing portion for said driving roller protrudes from said first frame portion outwardly in the widthwise direction, and said second frame portion is provided with a groove portion engaged with a part of said bearing portion and positions said driving roller relative to said second frame portion by said groove portion.

8. An image forming apparatus according to claim 1, wherein said first positioning portions include a partly opened groove portion and a partly opened elongated hole, and wherein supporting shafts of said stretching members are engaged with said groove portion and said elongated hole to position said stretching members.

9. An image forming apparatus according to claim 1, wherein said endless belt is an intermediary transfer belt for receiving a primary transfer toner image from said image bearing members, and one of said stretching members is a sliding member which is slidable on an inner surface of said endless belt and which is opposed through said endless belt to a secondary transfer member for secondary transferring the toner image from said intermediary transfer belt onto the transfer material, and wherein side frames as said first frame portion are provided at the widthwise end portions and at an opposite side of said sliding member, and wherein said side frames are made integral with each other by said sliding member.

10. An image forming apparatus according to claim 1, wherein said transfer unit is detachably mountable relative to said second frame portion.

* * * * *